United States Patent [19]

Satt et al.

[11] 4,070,716

[45] Jan. 31, 1978

[54] FOLDABLE PLAYPEN

[76] Inventors: Henry Satt, 1006 Neilson St.; Dave Neuberg, 833 Central Ave., both of Far Rockaway, N.Y. 11691

[21] Appl. No.: 706,925

[22] Filed: July 19, 1976

[51] Int. Cl.[2] ..... A47D 7/00

[52] U.S. Cl. ..... 5/99 C; 5/99 R

[58] Field of Search ..... 5/99 C, 99 B, 99 R

[56] References Cited

U.S. PATENT DOCUMENTS

| | | | |
|---|---|---|---|
| 1,782,217 | 11/1930 | Stoddard | 5/99 C |
| 2,958,084 | 11/1960 | Kenney | 5/99 R |
| 3,018,493 | 1/1962 | Wittbrodt | 5/99 R |
| 3,063,065 | 11/1962 | Shaw | 5/99 R |
| 3,119,124 | 1/1964 | Krauss | 5/99 R |
| 3,165,760 | 1/1965 | Abajian | 5/99 R |
| 3,924,280 | 12/1975 | Vaiano | 5/99 R |

*Primary Examiner*—Paul R. Gilliam

*Assistant Examiner*—Alex Grosz

*Attorney, Agent, or Firm*—Friedman, Goodman & Teitelbaum

[57] ABSTRACT

A foldable playpen having two end portions and two side portions which are interconnected to form a substantially square frame, and a flexible skirt forming a wall thereabout, where the two end portions are pivotable in a downward direction toward a center vertical leg located at each end, and the side portions are pivotable inwardly bringing the two folded end portions together, to thereby fold the playpen into a small, almost square area less than the area of the opened frame. The floor of the playpen is formed of spaced apart, hinged slats covered with a padding protection. The covered slats can be folded into a cylindrical shape which is adapted to receive the folded playpen frame therein, such that the entire playpen can be easily carried, such as by a handle connected thereto.

15 Claims, 10 Drawing Figures

FOLDABLE PLAYPEN

BACKGROUND OF THE INVENTION

This invention relates to a foldable playpen and more particularly to a new and improved construction which permits folding a playpen into a reduced size which is insertible within a foldable floor to permit ease of carrying and storage.

Conventionally, a playpen, or play yard, is provided for a baby to utilize during the daytime as a protected area for playing. It is generally of a portable construction which permits movement of the playpen to position it in an area which can be watched by the mother or other guardian. It must therefore be of lightweight material and of collapsable structure. At the same time, it is often desired to store or transport the playpen, and therefore, its construction must be of a type permitting it to be easily folded.

Most prior art playpens include a frame construction with hinges and linkages. The walls of the playpen are frequently of a net, formed of a fabric or plastic material which interconnects the frame. The floor of the playpen is either of single or split construction formed with hinges to permit it to be lifted up during folding of the playpen.

A typical construction is described in U.S. Pat. No. 3,092,847, issued June 11, 1963 to C. T. De Puy. This playpen includes an upper frame having two rigid U-shaped members with their free ends disposed adjacent to each other and pivotal in a downward direction. Diverging legs extend downward from the interconnected U-shaped frame members. Additional U-shaped members are connected near the bottom of the legs to form the lower frame. A single piece floor is pivotally mounted on one of the bottom members and is positioned to rest on the other bottom member, when the legs are pivoted apart. To fold the playpen, the bottom floor is lifted up and the legs are brought together while at the same time pivoting into a downward direction the two U-shaped members forming the top frame. The resulting foldable playpen forms a construction which lies along a substantially vertical plane. However, the length of the folded playpen is the full length of the entire playpen. As a result, the playpen must be stored in an area which has sufficient length to accommodate the playpen. Additionally, in transporting the playpen, it must be carried in a manner where there is sufficient room to accommodate this length.

Another foldable playpen is described in U.S. Pat. No. 3,206,772 issued Sept. 21, 1965, to R. J. Sarasin. In this construction, again the upper frame is formed of two U-shaped members with their free ends pivoted together. Diverging legs extend downward from the pivoted interconnected sections, and bars are interconnected between the legs to form the bottom frame. The floor member includes two sections pivoted one to the other and foldable along their axis. The outer edges of the floor members are pivotally connected to the two bars. In this playpen, the floor is moved upwardly at its center, the two legs are moved together and the top U-shaped members are pivoted in a downward direction. However, again the entire length of the playpen remains fixed, and in order to store or transport the playpen, sufficient length is needed to accommodate the entire length of the playpen.

In many cases, the storage area available is insufficient to accommodate the full length of the playpen.

Furthermore, when travelling and transporting the playpen in a vehicle, the length of the playpen is often greater than the available space in the trunk or rear portion of the vehicle and the playpen must be awkwardly carried on the roof or other external part of the vehicle. Furthermore, because of its length, it often becomes necessary for two people to carry the folded playpen to thereby be able to transport it.

SUMMARY OF THE INVENTION

It is accordingly an object of the present invention to provide a foldable playpen which avoids the aforementioned problems of prior art devices.

Still a further object of the present invention is to provide a foldable playpen whose folded condition provides both a length and a width which is substantially less than the unfolded length and width.

Another object of the present invention is to provide a foldable playpen having a frame construction with a removable floor, and wherein the floor can be folded into a cylindrical shape which can receive the folded frame to thereby permit the folded playpen to be carried as a unitary member.

Still another object of the present invention is to provide a foldable playpen having end portions and side portions, wherein the end portions can each be pivotally folded into a condition approaching two vertical planes and wherein the side portions can then be folded to bring together the two folded end portions, thereby forming a folded condition which occupies a small square area substantially less then the square area of the unfolded playpen.

Still a further object of the present invention is to provide a foldable playpen which is sturdy and secure in its unfolded condition, and easily transported and capable of easy storage when in a folded condition.

The present invention provides a foldable playpen including an upper frame having two end members and two side members. Each of the end members is formed of two sections which are respectively hingedly connected to each other at their respective inner ends. Each of the hinged interconnections form a junction. Two pair of legs are provided, each pair having its upper end hingedly interconnected at one of the junctions. In addition, two vertical legs are provided, each vertical leg having its upper end fixedly interconnected to a respective one of the aforementioned junctions. Each of the side members are also formed of two sections, which are respectively hingedly interconnected to each other at their inner ends. The outer ends of the side sections are hingedly interconnected to the outer ends of the end sections. Three bars are provided, wherein two bars are respectively hingedly interconnected between a corresponding leg from each of the two pairs of legs at points adjacent to the bottom ends thereof. The third bar is hingedly interconnected between the two vertical legs adjacent the bottom ends thereof. Each of the bars are also formed of two sections which are respectively hingedly interconnected to each other at their respective inner ends.

In an unfolded condition, each of the side members and each of the three bars are horizontal and substantially parallel to each other. Each of the end members are horizontal and are substantially perpendicular to the side members. The two pairs of legs diverge downwardly from their respective junctions. In a folded condition, the end members are pivotal downward, and the pair of legs are pivotal inward, toward their respective vertical leg, whereby each of the two end sections form a folded end, wherein the end members, the pairs of diverging legs, and the vertical legs are parallel and adjacent to each other. Each of the side members are pivotal inward, and the bars are pivotal upward and inward, to bring together the folded ends thereby to occupy a small square area which has both a length and width less than the unfolded length and width.

The floor of the playpen is formed of a plurality of spaced apart slats which are hinged together, and includes padding means covering the slats. In its unfolded condition the floor fits on the bottom of the playpen and is supported by the three bars. In its folded condition, the floor forms a cylinder which can receive the folded frame. A handle placed on the outside of the cylinder permits easy transportation of the entire playpen frame and floor.

BRIEF DESCRIPTION OF THE DRAWINGS

With the above and additional objects and advantages in view, as will hereinafter appear, this invention comprises the devices, combinations and arrangement of parts hereinafter described by way of example and illustrated in the accompanying drawings of a preferred embodiment in which like reference numerals designate like parts throughout the figures thereof and wherein.

DESCRIPTION OF THE PREFERRED EMBODIMENT

Figure 1:
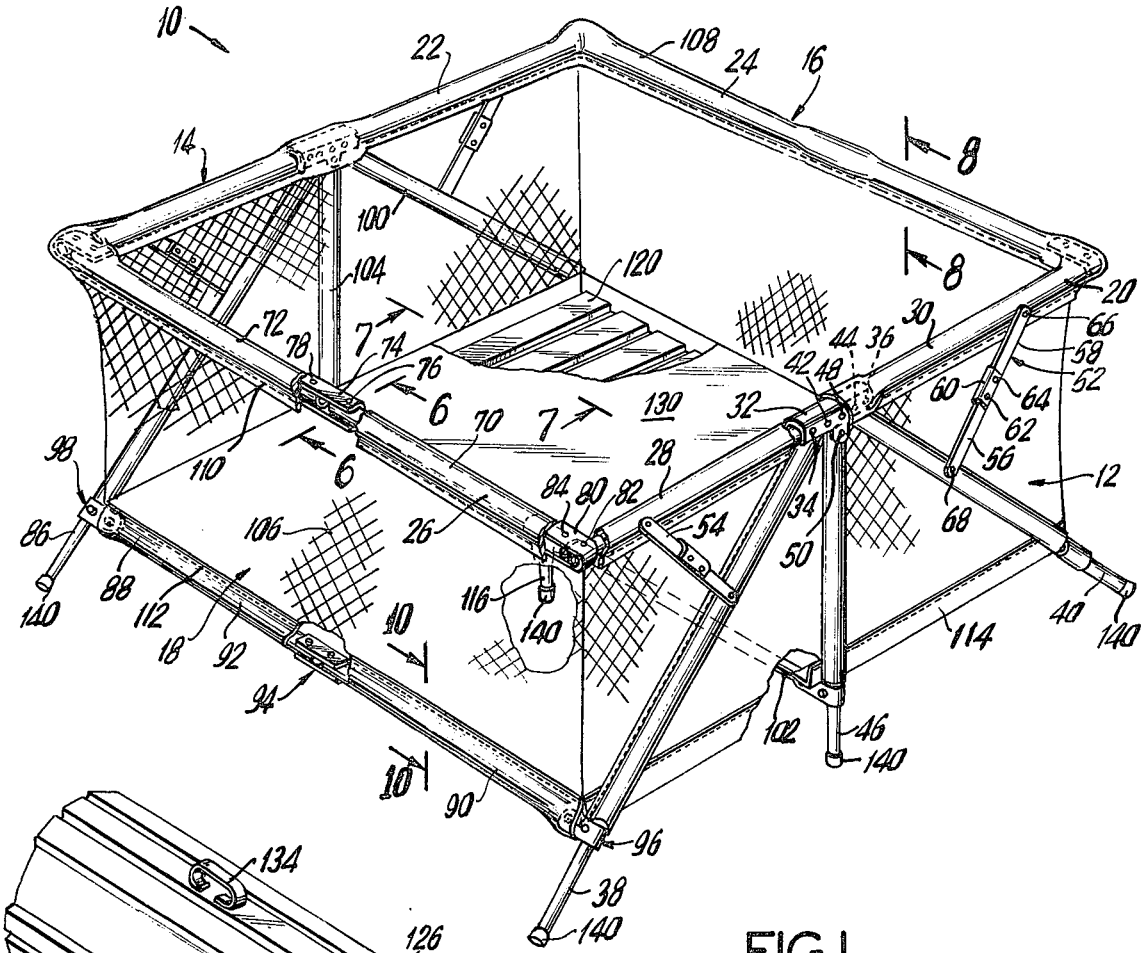
FIG. 1 is an isometric view of the unfolded playpen with portions broken away for ease of viewing the component part.

Referring now to FIG. 1, the playpen 10 is shown as a substantially square form and includes a front end 12, a rear end 14, a right side 16 and a left side 18. The upper frame is formed by front and rear end members 20 and 22, and side members 24 and 26. The front end member 20 is formed of left and right sections 28, 30 which are pivotally interconnected at their respective inner ends by bracket 32. Bracket 32 is formed as a U-shaped member with its bight on the top of the frame and covers the inner ends of sections 28 and 30, the section 28 being pivotally held by means of pin 34, while the inner end of section 30 is held by means of the pin 36.

A pair of legs 38, 40, are positioned with their upper ends connected to the bracket 32 by means of respective pivot pins 42 and 44. A vertical leg 46 is also connected to the bracket 32 by means of a center pin 48 and is held in fixed relationship to the bracket by means of an additional pin 50.

A brace 52 is positioned between the right section 30 and the right leg 40, and a corresponding brace 54 is positioned between left section 28 and left leg 38. Brace 52 is formed of first and second sections 56, 58 which are pivotally interconnected by means of a U-shaped hinge 60 having a first pin 62 pivotally supporting the upper end of section 56, and a pin 64 pivotally supporting the lower end of section 58. The upper end of section 58 is pivotally connected to section 30, by means of pin 66 while the lower end of section 56 is pivoted to leg 40 by means of pin 68.

Brace 54 is formed identically to brace 52. Also, the rear end 14 of the playpen is formed in identically to the front end 12, and therefore there is no need for these elements to be described in detail.

Left side member 26 includes a front section 70 and a rear section 72 having their respective inner ends pivotally interconnected by means of a U-shaped hinge 74 whose bight is placed on the inside of the frame and whose legs cover the inner ends of sections 70 and 72. The front section 70 is pivotally connected to the hinge 74 by means of pin 76, and the rear section 72 is pivotally connected to the hinge 74 by means of the pin 78.

The front end of the side section 70 is pivotally connected to the left end of the front end section 28 by means of a U-shaped clip 80, with section 28 being fixedly secured to the clip by means of pin 82 and the bight portion of the clip 80, while side section 70 is pivotally connected to the clip 80 by means of the pivot pin 84.

The right side member 24 is identical to the aforedescribed left side 26. Similarly, at each of the four corners there is located a U-shaped clip as aforedescribed so that each of the side sections are pivotally interconnected to the end sections.

Connecting the left legs 38 and 86 is a first bar 88 formed of two sections; a front section 90 and a rear section 92. The two sections are interconnected by means of a U-shaped hinge 94 similar to the aforedescribed hinge 74. The front and rear ends of the bar 88 are interconnected to the respective legs 38, 86 by means of U-shaped clips 96, 98 which are similar to the aforedescribed U-shaped clip 80. A second bar is positioned between the right legs 40, 100 and is also formed of two pivoted sections connected by a U-shaped hinge similar to hinge 94.

A third bar 102 is interconnected between the two vertical legs 46 and 104 and is similarly formed of two pivotally interconnected sections which are joined by U-shaped hinge 105. The front and rear ends of the bar 102 are pivotally connected to the respective vertical legs 46 and 104 by means of the aforedescribed U-shaped clips.

The side wall of the playpen is formed as a flexible skirt 106 which can be a net made out of vinyl, fabric, or other flexible material. In order to more clearly see the various parts of the playpen, portions of the net wall have been broken away.

Figure 10:
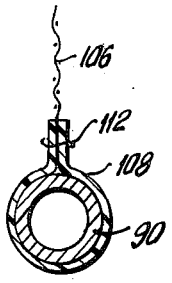
FIG. 10 is a sectional view of the lower bars of the playpen taken alone line 10—10 of FIG. 1.
Figure 8:
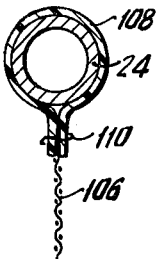
FIG. 8 is a sectional elevational view of the padded frame and flexible wall of the playpen taken along line 8—8 of FIG. 1.

Each of the frame members and the legs are covered by a padded sleeve 108 which can be formed of vinyl, fabric, or other padded material. As can best be seen in FIGS. 8 and 10, the flexible skirt is connected to the upper frame by the stitching 110 coupling at the padded sleeve 108, and is attached to the bottom bars by the stitching 112 which is coupled to the padding covering those bars. It is to be noted that on the front and rear lower end portions, there are no lower members or bars. As a result, the padded material is formed in an Lshape with an upwardly folded cuff 114 which extends between the two side sewn sections. In this manner, a framed compartment is formed on the bottom of the playpen by means of the cuffs 114 on the front an rear end portions of the lower frame, and sewn portion of the net connecting it to the padded sleeve covering the left and right bars.

A center leg 116 is fixedly interconnected to the center bar 102 at its U-shaped hinge 105 which pivotally interconnects its two sections.

It its unfolded condition, as shown in FIG. 1, the front and rear end members 20, 22 are held in horizontal and parallel relationship by means of the braces 52, 54 which are held extended as dead center locks; the legs 38, 40 and 86, 100 are held divergingly apart, and the vertical legs 46 and 104 are held in a vertical upright position. The side members of the upper frame 24, 26 are also held in horizontal and substantially parallel relationship and are perpendicular to the front and rear end members. The bars on the lower level are held extended and in parallel horizontal relationship. In its unfolded condition, the net will be spread around the sidewall and a floor can be placed on the bars, supported thereby.

Figure 2:
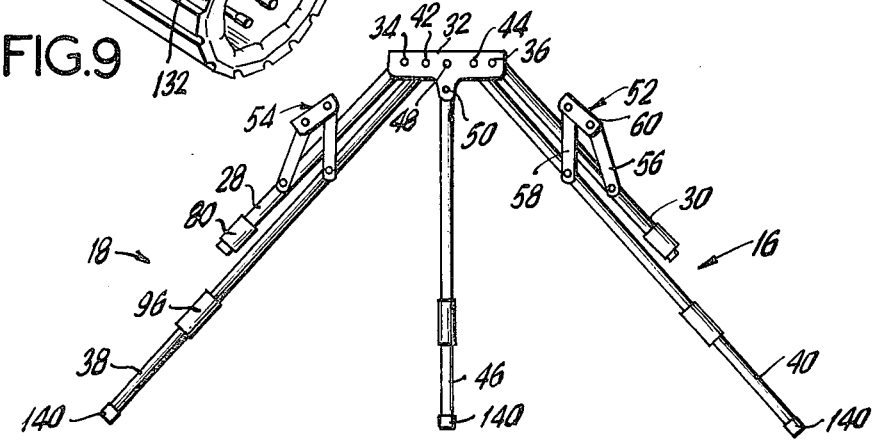
FIG. 2 is an end elevation view of the playpen in a partially folded condition.
Figure 3:
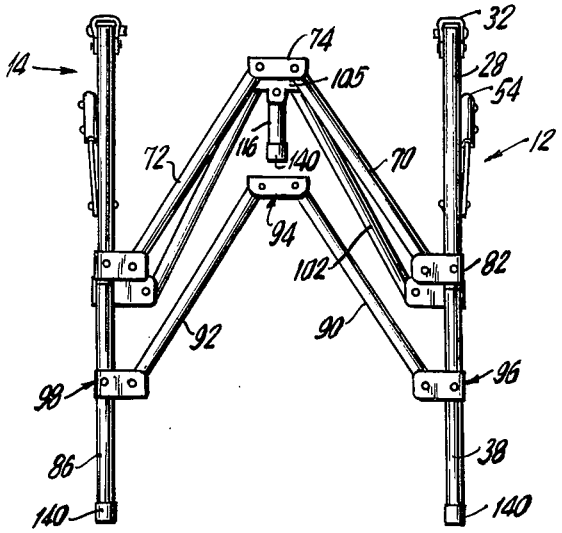
FIG. 3 is a side elevation view of the playpen in a partially folded condition.
Figure 4:
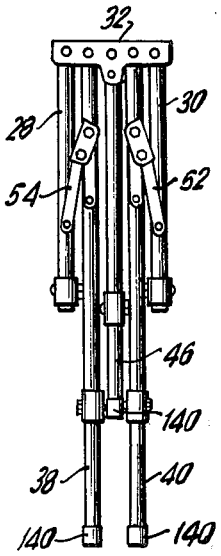
FIG. 4 is an end elevation view of the completely folded playpen.

The folding of the playpen can best be described with respect to FIGS. 2–5. It should be noted that in these figures the net and padding have been eliminated for clarity. To fold the playpen, the dead center locks 52, 54 are broken permitting the end sections 28 and 30 to pivot about their respective pins 34 and 36 in a downward direction. At the same time legs 40 and 38 are permitted to pivot about their pins 42 and 44 inwardly, toward the upright leg 46 which is held fixed by means of the pins 48, 50. The pivoting of the front and rear ends will continue as shown in FIG. 2 until the legs 38 and 40, and end sections 28 and 30 all are in a vertical position and lying adjacent to each other. The front and rear end portions 12 and 14 will then form folded ends as shown in FIG. 4 with the end members and legs at each end lying adjacent to each other.

The side sections 16 and 18, are also folded by pushing in on each of the U-shaped hinges holding the upper side members and the lower bars. The upper side members will pivot on the U-shaped clips holding them to the front and rear end members to have the sides move inwardly of the playpen. The outer two bars will be pivoted inward and upwardly, and the center bar will be pivoted upwardly, as shown in FIG. 3.

Figure 5:
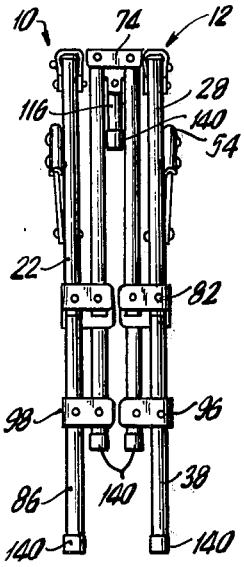
FIG. 5 is a side elevation view of the completely folded playpen.

As the sides are continued to be folded upward and inward, they will cause the front and rear ends to move toward each other until they are collapsed as shown in FIG. 5, with the front end 12 and the rear end 10 lying adjacent to each other and in vertical parallel relationship.

Referring to FIGS. 4 and 5, it will be noted that in its folded condition, the playpen frame forms an approximate square with all of the members and legs being directly adjacent to each other and occupying a substantially small space. Both the length and width of the folded playpen are substantially smaller than the unfolded length and width.

Figure 7:
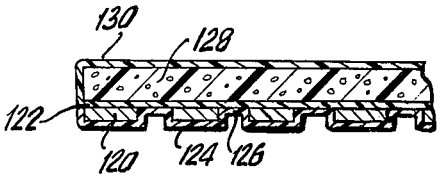
FIG. 7 is a sectional elevation view of the floor of the playpen taken along line 7—7 of FIG. 1.

The floor of the playpen is shown in FIGS. 1 and 7, and is formed of a plurality of spaced apart slats 120 which are hingedly interconnected to form a foldable arrangement. The hinges are formed by placing a pliable material such as vinyl, over the slats at 122 and beneath the slats at 124, and heat sealing the bottom portion to the upper portion at 126 to thereby form a hinge connection between adjacent slats. A padding material 128, such as foam or other soft material, is placed above the slats and covered with vinyl or other pliable material 130 which is joined to the pliable material forming the hinges in a conventional manner well known in the art, such as heat sealing.

Figure 9:
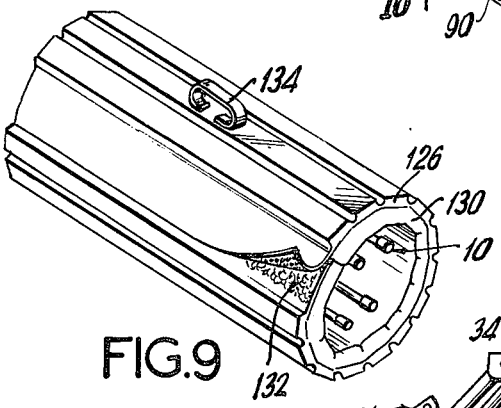
FIG. 9 is an isometric view of the folded floor with the folded playpen frame contained therein.

The floor is sized to fit within the bottom portion of the playpen and be supported by the slats resting on the three bars of the bottom frame and additionally on the horizontal portions of the cuffs 114. To fold the floor, it is removed from the playpen, and rolled into a cylindrical shape as shown in FIG. 9. Placed along the outer edges of the floor can be a fastening means, such as the two parts of a Velco fastener 132, which permits fastening the ends of the floor and maintaining it in its cylindrical shape. The folded frame 10 can be placed within the center of the cylindrical folded floor. Placing a handle 134 on the outer portion of the floor, as for example by heat sealing, makes it possible to carry the entire folded playpen.

Figure 6:
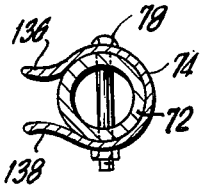
FIG. 6 is a sectional view of the side hinge taken alone line 6—6 FIG. 1.

Referring now to FIG. 6, it will be noted that the inner ends of the U-shaped hinge 74 are bowed inwardly at 136 and 138 to grasp the section of the frame to which it is connected. This forms a spring lock which retains the section in its horizontal position when in an unfolded condition.

At the end of the legs, caps 140 are included to provide a soft engagement with the floor. Additionally, caps can be placed at the end of the various sections to prevent any harm to the child should the padding accidentally be cut or removed from the end portions of the sections. The various sections can be formed out of tubular material and can be made of a sturdy constructions such as aluminum, steel, etc.

Numerous alterations of the structure herein disclosed will suggest themselves to those skilled in the art. However, it is to be understood that the present disclosure relates to a preferred embodiment of the invention which is for purposes of illustration only and is not to be construed as a alimitation of the invention.

What is claimed is:

1. A foldable playpen comprising:

an upper frame including two end members and two side members;

each end member including two end sections hingedly interconnected to each other at their respective inner ends to provide junctions;

two pairs of legs, each pair having its upper ends hingedly interconnected with a respective one of said end members at said junction;

two vertical legs, each having its upper end fixedly interconnected to a respective one of said end members at said junction;

each side member including two side sections and first hinge means interconnecting said two side sections to each other at their inner ends for permitting said two side sections to be pivoted inward towards each other into a substantially parallel position with respect to each other, second hinge means interconnecting outer ends of said two side sections to outer ends of said end sections for permitting each of said two side sections to be pivoted to a substantially parallel position with respect to an associated connected one of said end sections;

three bars, each bar including two bar sections and third hinge means interconnecting said two bar sections to each other at their inner ends for permitting said two end sections to be pivoted inward towards each other into a substantially parallel position with respect to each other, fourth hinge means interconnecting outer ends of two of said bars respectively between a corresponding leg on each of said pairs of legs adjacent bottom ends thereof for permitting each of said bar sections of said two bars to be pivoted to a substantially parallel position with respect to said corresponding leg connected thereto, fifth hinge means interconnecting outer ends of the third bar between said vertical legs adjacent bottom ends thereof for permitting each of said bar sections of said third bar to be pivoted to a substantially parallel position with respect to an associated connected one of said vertical legs;

wherein, in an unfolded condition, each of said side members and said three bars are horizontal and substantially parallel to each other, each of said end members are horizontal and substantially perpendicular to said side members, and said pairs of legs diverge downwardly from their respective junctions;

and in a folded condition, each of said end members are pivoted downward, said pairs of legs are placed inward toward their respective upright legs to provide folded ends, each of said side members are pivoted upward and inward, and said bars are pivoted upward and inward to bring said folded ends towards each other;

whereby longitudinal axes of each of said end sections, side sections, bar sections and legs are disposed in the same direction in said folded condition to provide a compact arrangement.

2. A foldable playpen as in claim 1, wherein said first and third hinge means include U-shaped hinges each having two pins therethrough, said hinges respectively covering said interconnnected sections of said two side members and said interconnected sections of said three bars, said inner ends of each of said interconnected side and bar sections being respectively coupled to the two pins of the hinge.

3. A foldable playpen as in claim 2, and wherein legs of said U-shaped hinges are inwardly bowed to form a spring-clip about the sections being interconnected.

4. A foldable playpen as in claim 1, wherein said second, fourth and fifth hinge means include U-shaped clips each having at least one pin therethrough, said clips respectively interconnecting said end members to said side members and interconnecting said bars to said legs, said clips being respectively fixedly attached to said end members and said legs, and respectively pivotally attached to said side members and said bars.

5. A foldable playpen as in claim 1, and further comprising a flexible skirt connected at its upper edge to said upper frame around a perimeter thereof, and at its lower edge to said first two bars on the sides of the playpen, and further including upwardly extending cuffs formed on the lower edge of said skirt along the two end portions of the playpen.

6. A foldable playpen as in claim 5, and further comprising padding means formed around each of said side members, said end members, said legs, and at least the first two of said bars.

7. A foldable playpen as in claim 6, and wherein said padding means includes a sleeve, said skirt being connected to said sleeve.

8. A foldable playpen as in claim 1, and further comprising a brace interconnecting each leg of said pairs of legs with its adjacent section of said end members, said brace holding the end members in their horizontal position during the unfolded condition.

9. A foldable playpen as in claim 8, and wherein each brace includes two sections having their inner ends pivotally interconnected, the outer end of one section pivotally connected to a leg, the outer end of the other section pivotally connected to an end section, and hinge means coupled to the interconnected inner ends to form a dead center latch.

10. A foldable playpen as in claim 1, and further comprising two U-shaped brackets having fine horizontal pins therethrough, each bracket covering a respective one of said junctions, the inner ends of said end member pivotally connected to the outer pins of the bracket, the upper ends of a pair of legs pivotally connected to the next inner pins of the bracket, and said vertical legs fixedly connected to the middle pin of the bracket.

11. A foldable playpen as in claim 1, and further comprising a downwardly extending center leg fixedly coupled at the interconnected sections of said third bar.

12. A foldable playpen as in claim 1, and further comprising a foldable floor removably supported by said three bars.

13. A foldable playpen as in claim 12, and wherein said floor comprises a plurality of spaced apart slats, hinge means interconnecting adjacent slats to form a foldable arrangement, and padding means covering said slats.

14. A foldable playpen as in claim 13, and wherein said hinge means includes a pliable covering, individually sealed around each slat.

15. A foldable playpen as in claim 14, and further comprising fastening means having mating parts respectively connected at opposite ends of said floor for maintaining said floor in a cylindrical form when in a folded condition, said cylindrical form capable of receiving said playpen frame when in a folded condition.

* * * * *